United States Patent [19]

Hamelink et al.

[11] 4,168,949

[45] Sep. 25, 1979

[54] FLAME SIGNAL STABILIZATION CIRCUIT

[75] Inventors: William B. Hamelink, Richfield; Roger A. Schilling, West Saint Paul, both of Minn.

[73] Assignee: Honeywell Inc., Minneapolis, Minn.

[21] Appl. No.: 836,453

[22] Filed: Sep. 26, 1977

[51] Int. Cl.[2] ..... F23N 5/10

[52] U.S. Cl. ..... 431/80; 137/66; 328/6

[58] Field of Search ..... 431/78, 80, 75, 66; 328/6; 331/66; 137/66

[56] References Cited

U.S. PATENT DOCUMENTS

| | | | |
|---|---|---|---|
| 3,814,569 | 6/1974 | Jacobsz | 431/29 |
| 3,853,455 | 12/1974 | Riordan | 431/80 |
| 3,861,854 | 1/1975 | Walbridge | 431/80 |
| 3,914,092 | 10/1975 | Matthews | 431/80 X |
| 3,941,553 | 3/1976 | Bedford | 431/80 |

*Primary Examiner*—Edward G. Favors
*Attorney, Agent, or Firm*—Alfred N. Feldman

[57] ABSTRACT

A flame rectification system is disclosed wherein a flame rod is used to detect the presence of a flame to control a relay or solenoid operated valve. Upon the initial indication of a flame, a pulse generating circuit momentarily overrides the flame rod signal and locks in the relay or valve. This allows the flame at the associated burner to stabilize before the relay or solenoid valve can close in the event of a momentary absence of a flame signal which could result from instability during the flame establishing process.

15 Claims, 2 Drawing Figures

FLAME SIGNAL STABILIZATION CIRCUIT

BACKGROUND OF THE INVENTION

In the field of fuel burners, particularly gas fired equipment such as gas furnaces, it had been common practice to provide a continuously lit or "standing" pilot. The use of a "standing" pilot was very inexpensive and was reliable in that the pilot was lit and normally was of sufficient size and strength to light a main burner whenever the fuel supply to the main burner was open. Basically this same concept existed in the oil burner market in that a constant source of spark ignition normally would be provided with a supply of oil and air to the burner.

Since the advent of the shortage and the subsequent higher price for gas and oil as fuels, efforts have been devoted to eliminate any unnecessary consumption of these fuels. In the field of gas fired equipment, the "standing" pilot is being replaced by intermittently operated ignition sources that either directly light a pilot for subsequent use as a light-off means for the main burner, or directly light the main burner itself. In the area of spark ignition for oil burners, an attempt has been made to utilize interrupted or intermittent ignition of the oil burner with the ignition source turned off immediately after a flame has been established at the oil burner. In both of these types of systems, a flame sensing arrangement is used to detect the presence of the flame for keeping the fuel valve open to continue the supply of main fuel to the burner. It has been found that at the initial lightoff of either the pilot or of a main burner, whether it be gas or oil, that an unstable flame may result. Many of the electric control systems now being proposed are fast enough in response so that the absence of, or momentary blowing of a flame away from a sensing element, causes the main valve to immediately close. This causes unnecessary cycling of the main valve and numerous attempts for the ignition system to restart the system. In systems that use a pilot light and a main burner, once the pilot is established, the main burner immediately comes on. This can cause a sudden movement in the air around the pilot flame which either blows the pilot flame out or moves it away from a flame sensing device, such as a flame rod. This unstable condition has been met in most prior art installations by very carefully selecting the type of pilot, the selection and placement of the main burner, and the very careful placement of the flame sensing means. This has added unnecessary complexity and expense to the design of gas and oil fired burner equipment.

SUMMARY OF THE INVENTION

In the present invention, a substantially conventional ignition system and flame sensing system have been disclosed. In order to overcome the problems created by the lack of stability of the flame, whether it be a pilot flame or a main burner flame, the present invention utilizes an override circuit that simulates the presence of a flame for a very short period of time once a flame has been initially sensed. This override function is accomplished by providing a pulse of energy in the electronic circuitry that controls the fuel valve to simulate the presence of a flame for some minimum period of time so that the main fuel valve cannot be closed while the pilot or main flame is being established. In effect, once a flame is initially detected by the flame sensing circuit, a pulse generating circuit is activated which simulates the presence of flame for a period of, for example, two to four seconds depending on the installation and type of furnace involved. This allows the main fuel valve to remain open for a short period of time to allow the flame to stabilize, but does not keep the fuel valve open sufficiently long to cause any damage if in fact no flame is maintained. The exact type of pulse is not material. Its length of time is selected to be short enough so that the particular burner and fuel being used do not create an unsafe mode of operation.

The present system also, since it uses a sharp reverse pulse, provides an output signal at the shutdown of the burner which ensures that the burner is properly deenergized.

DESCRIPTION OF THE PREFERRED EMBODIMENT

Figure 1:
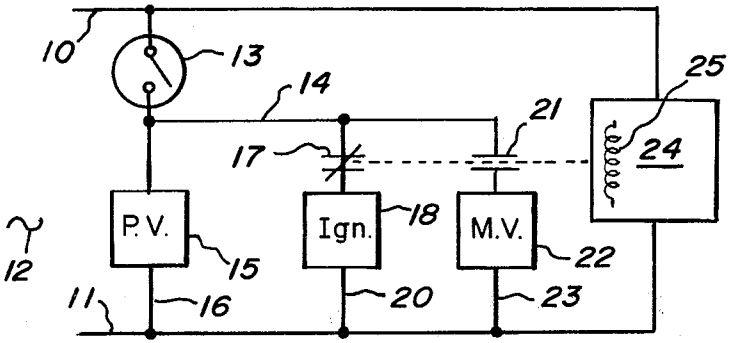
FIG. 1 is a block diagram of a typical fuel burner system which would be adapted to use the present invention.

In FIG. 1, the present invention is shown as embodied in, or adapted to be connected to, a fuel burner which can be considered as a gas type of burner. A pair of conductors 10 and 11 are provided which supply a conventional source of alternating current 12. A thermostatic switch 13 is connected to conductor 10 and to a common conductor 14 which energizes a pilot gas valve 15 through conductor 16 back to the conductor 11. Conductor 14 further energizes a normally closed relay contact 17 that is connected to a conventional ignition source, such as a spark transformer 18 and which is connected by conductor 20 to the conductor 11. A normally open relay contact 21 is connected to the main gas valve 22 and a conductor 23 back to the conductor 11. A flame signal stabilization circuit 24 is generally disclosed as having a relay coil 25 with the flame signal stabilization circuit 24 energized between the conductors 10 and 11. The relay 25 operates the contacts 17 and 21.

The operation of FIG. 1 will be briefly described. When the thermostat 13 closes, the pilot valve 15 is energized and pilot fuel is admitted to a burner. At that time, the contact 17 is closed to supply energy to the ignition source 18 which is capable of lighting the fuel from the pilot valve 15. As soon as the fuel from the pilot valve 15 ignites, the flame signal stabilization circuit 24 senses the presence of the flame, and the relay 25 operates to open the ignition source 18 and close the contact 21 so that the main valve 22 for the burner is opened. At this same time, the flame signal stabilization circuit 24 internally generates a pulse of energy that locks the relay 25 into its operated position for some short period of time to allow the pilot flame to become established along with the main flame. If this is not done, the gas emanating from the main burner can either extinguish the pilot flame or can momentarily blow the pilot flame away from a flame sensing means, such as a flame rod. In electronic control systems, this short absence of a flame signal would normally allow the main valve 22 to close and the system would start to cycle in an attempt to establish a stable flame. In the present invention, the override pulse that is generated within the flame signal stabilization circuit 24 makes sure that the main valve stays open for a sufficiently long period of time so that a stable flame can be established even though the flame sensor may not be receiving a stable flame signal.

Figure 2:
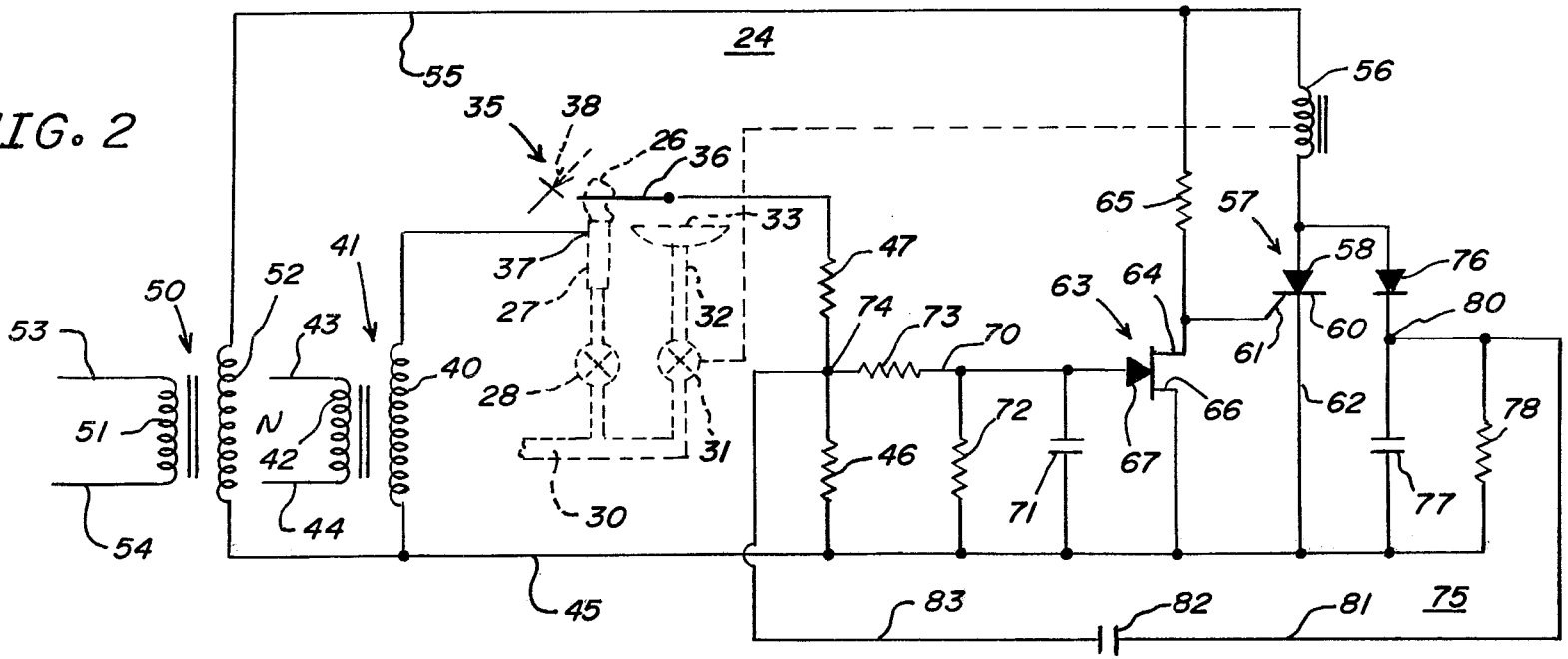
FIG. 2 is a schematic circuit diagram of one form of the invention applied to a pilot and main burner for a gas fired furnace.

In FIG. 2 the flame signal stabilization circuit 24 is shown in detail. The stabilization circuit 24 is adapted to sense a flame shown at 26 which emanates from a pilot burner disclosed at 27. The pilot burner has a control valve 28 and is fed from a fuel source 30. The fuel source 30 is further connected to a valve means 31 that can be a solenoid type valve or other electromagnetically operated type of valve. The valve 31 feeds a fuel conduit 32 that is connected to a main burner 33. The pilot burner 27 and the main burner 33 along with the associated valves and fuel supply means generally form a fuel burner and ignition source to which the present flame signal stabilization circuit 24 is adapted to be connected.

A flame sensing means is generally disclosed at 35 and is made up of a flame rod 36 and a connection 37 that is shown as connected to the pilot burner 27. A flame rectification symbol 38 has been disclosed to show the direction of flame rectification current that results in the use of a flame sensing means 35. A flame rectification type of system has a current flow through a flame with the net resultant current being larger in one direction than the other, and therefor appears as a rectified current in the direction shown by the rectification symbol 38.

The connection 37 is connected to a secondary winding 40 of a transformer 41 which has a primary winding 42 that is connected by conductors 43 and 44 to any convenient source of alternating current. The secondary winding 40 further is connected to a common conductor 45 for the system, which in turn is connected through a resistor 46 and a resistor 47 back to the flame rod 36. The flame rod 36, the resistors 47 and 46, along with the potential from the secondary winding 40 provides a voltage drop across the flame rod 36 and the pilot burner 27 so that a rectified current 38 will flow whenever a flame 26 is present. This flame sensing means 35 has been disclosed as an example of one type of flame sensing means that can be used, and is exceedingly simple and inexpensive.

The overall flame signal stabilization circuit 24 is energized by a further transformer 50 which has a primary winding 51 and a secondary winding 52. The primary winding 51 is connected to a pair of conductors 53 and 54 which have been shown separate from the conductors 43 and 44, but which could be common with them. Also the transformers 41 and 50 could be a single transformer with the appropriate windings. The transformers 41 and 50 have been shown separately for ease of describing the overall operation of the system, which will follow after a description of the system.

The secondary winding 52 is connected to the common conductor 45 and to a further conductor 55 which forms an energy supply circuit to an electromagnetic element 56 that can be either a relay (as disclosed in FIG. 1 as the relay 25) or can be the coil of a solenoid for the valve 31. The element 56, along with the associated valve 31, forms a fuel valve means that is operated in the manner disclosed in FIG. 1 as the main valve 22. The electromagnetic element 56 is connected to a silicon controlled rectifier generally disclosed at 57 which has an anode 58 and a cathode 60 along with a control gate 61. The silicon controlled rectifier 57 could be any solid state switch means, but has been shown as a silicon controlled rectifier for simplicity sake. The cathode 60 of the silicon controlled rectifier 57 is connected by conductor 62 to the common conductor 45.

Connected between the conductors 45 and 55 is a field effect transistor generally disclosed at 63 having a drain 64 connected through a resistor 65 to the conductor 55, while having a second element or source 66 connected to the common conductor 45. The field effect transistor, which is a high impedance solid state switch means, is completed by having a gate 67. The application of a negative potential to the gate 67 tends to reduce the conductivity of the field effect transistor 63 from substantially a short circuit to a substantially open circuit. This function will be utilized in the operation of the circuit, and will be described in detail in the operation of the overall circuit. The gate 67 is connected to a conductor 70 that has a capacitor 71 connected between it and the common 45. Also paralleling the capacitor 71 is a resistor 72. The conductor 70 connects through a resistor 73 to a junction point 74 between the resistors 46 and 47 of the flame sensing means 35.

To complete the overall circuit, a pulse generating circuit means 75 has been disclosed, and includes a diode 76 and a capacitor 77 which are connected in series and are connected across the anode 58 and cathode 60 of the silicon controlled rectifier 57. Paralleling the capacitor 77 is a resistor 78 which is connected between the common conductor 45 and a junction point 80. The junction point 80 is connected by a conductor 81 to a capacitor 82 that acts as an output for the pulse generating circuit means 75 and which has a further conductor 83 connected to the junction 74 between the resistors 46 and 47 of the flame sensing means 35. The pulse generating means 75 includes a number of capacitors and resistors along with the diode 76 so that a pulse can be coupled into the flame sensing means 35 at the junction 74 which forms the input of a switch means that has as its main components the field effect transistor 63 and the silicon controlled rectifier 57.

OPERATION OF FIGURE 2

The easiest way to understand the operation of the circuit disclosed in FIG. 2 is to consider the fuel burner means that has been disclosed as made up of the pilot burner 37 and the main burner 33. Power can be considered as continuously applied to the transformers 50 and 41. With this arrangement it should be understood that at startup the valves 28 and 31 are closed so that no fuel flows while a current flows through the electromagnetic element 56 and the diode 76 to charge the capacitor 77 with a voltage. The burner generally disclosed in FIG. 2 is started by providing any convenient means for opening valve 28 and lighting flame 26. The valve 28 could be opened manually with the flame 26 being established by a match, or the valve 28 can be electromagnetically operated along with some type of spark source or hot wire igniter to generate the flame 26. The manner in which the flame 26 is brought into being is not material to the present invention.

As soon as the flame 26 appears, a rectified current as disclosed at 38 appears, and current flows through the resistors 46 and 47 so that the junction 74 has a negative potential. This potential will be negative with respect to the common 45, and is of the correct potential to cause the field effect transistor 63 to turn "off" or cease conducting current through the resistor 65. Up until this time, if electric power has been supplied, the field effect transistor 63 has, in effect, been a short circuit between the gate 61 and the cathode 60 of the silicon controlled rectifier 57 thereby keeping the silicon controlled rectifier out of conduction. As soon as a negative potential appears at the junction 74, the field effect transistor 63 is turned "off", and the short circuit is removed from the gate 61 to the cathode 60 of the silicon controlled rectifier 57. The potential applied through the resistor 65 then drives the silicon controlled rectifier 57 into conduction which supplies a sufficient amount of electric current in the electromagnetic element 56 to cause the electromagnetic element 56 (whether it be a relay or a solenoid for the valve 31) to be energized. This opens the valve 31 and admits gas to the burner 33.

At this moment, the gas emanating from burner 33 can extinguish the flame 26, can cause the flame 26 to move away from the flame rod 36 thereby indicating a loss of flame, or the gas emanating from the burner 33 can be properly ignited. The present flame signal stabilization circuit 24 ensures that whatever happens, the electromagnetic element 56 is continued to be energized for a short period of time. This is accomplished by the fact that as soon as the silicon controlled rectifier 57 starts to conduct, the diode 76 ceases to supply energy to the capacitor 77, and the pulse generating network 75 comes into operation. The capacitor 77 immediately starts to discharge through the resistor 78 and generates a pulse at 80 on conductor 81 which is coupled through the capacitor 82 to the junction 74 where it appears as a negative going voltage with respect to the common 45. This keeps the field effect transistor 63 "off" for whatever time is established by the pulse generating means 75. In the particular pulse generating circuit means 75, a resistance-capacitance discharge pulse is provided. The type of pulse provided could be of some other type, such as a square-wave, and it still would be appropriate. As long as the pulse is coupled to the junction 74, the field effect transistor 63 is kept "off" which keeps the silicon controlled rectifier 57 conducting and the electromagnetic element 56 energized. Thus, even if the flame is momentarily blown away from the flame rod 36, this loss of flame signals does not allow the valve 31 to close for some preselected time based on the length of the pulse. In a typical gas furnace installation, this pulse length would be approximately two seconds and would allow the stabilization of the flame 26 and any flame which emanated from the burner 33.

As soon as the pulse generating circuit means 75 has depleted the charge on capacitor 77, the pulse disappears and the system operates under the control of the flame rod 36. In normal operation a negative potential will appear at the junction 74 from the flame 38 and will keep the field effect transistor 63 out of conduction thereby keeping the electromagnetic element 56 energized to keep the fuel valve 31 open.

At the turn off of the system, the pulse generating means 75 has a discharged capacitor 77. The turn off of the system causes the loss of flame at the burner 33, and the loss of the flame at the pilot 27 thereby removing the negative potential at junction 74. This allows the field effect transistor 63 to go into conduction. This deenergizes the silicon controlled rectifier 57 and allows the electromagnetic element 56 to drop out the valve 31. At this time the capacitor 77 immediately takes on a charge through the diode 76 which creates a pulse in a positive direction through the capacitor 82 to the junction 74 which drives the field effect transistor 63 fully "on" to insure that no chatter or false indication of flame can inadvertently be coupled into the system.

The present system has been disclosed as specifically operating with a pilot valve and a main valve in a gas burner environment. The system could be readily used with a direct spark ignition type of gas burner where only a single burner is used and no pilot is provided. Application of this same concept to any type of fuel burner is possible and would be readily apparent after the above disclosure. In view of the above disclosure and the wide application that the present invention could have, the applicants wish to be limited in the scope of their invention solely by the scope of the appended claims.

The embodiments of the invention in which an exclusive property or right is claimed are defined as follows:

1. A flame signal stabilization circuit adapted to sense a flame and which controls the energization of electrically controlled fuel valve means for a burner, including: flame sensing means including output means adapted to sense said flame at said burner and effecting a change in said output means between the presence and the absence of said flame; switch means including connection means connected to electrically control said fuel valve means; said switch means energizing said fuel valve means upon an indication of said flame by said flame sensing means; and pulse generating circuit means connected to said switch means to cause said switch means to keep said fuel valve means energized for a short period of time upon a momentary indication of the presence of flame as indicated by said flame sensing means to insure that said flame has time to stabilize before said flame sensing means is placed in continuing control of said burner.

2. A flame signal stabilization circuit as described in claim 1 wherein said switch means includes solid state switch means connected to control said valve means.

3. A flame signal stabilization circuit as described in claim 2 wherein said solid state switch means is a silicon controlled rectifier; and said silicon controlled rectifier is connected to control an electromagnetically operated element to in turn control said valve means.

4. A flame signal stabilization circuit as described in claim 3 wherein said electromagnetically operated element is a solenoid for said valve means.

5. A flame signal stabilization circuit as described in claim 2 wherein said flame sensing means includes flame rectification means adapted to cooperate with said burner to allow current to flow through said flame rectification means when said flame is present at said burner and wherein the net current flow is unidirectional.

6. A flame signal stabilization circuit as described in claim 5 wherein said solid state switch means includes high impedance solid state switch means connected to respond to said unidirectional current flow; and said solid state switch means further including solid state output switch means connected to an output of said high impedance solid state switch means and controlled thereby.

7. A flame signal stabilization circuit as described in claim 6 wherein said high impedance solid state switch means is a field effect transistor; and said solid state output switch means is a silicon controlled rectifier.

8. A flame signal stabilization circuit as described in claim 7 wherein said silicon controlled rectifier is connected to control an electromagnetically operated element to in turn control said valve means.

9. A flame signal stabilization circuit as described in claim 8 wherein said electromagnetically operated element is a solenoid for said valve means.

10. A flame signal stabilization circuit as described in claim 8 wherein said pulse generating circuit means includes capacitor means and resistor means capable of storing a charge when no flame exists and subsequently producing a current pulse to said field effect transistor for said short period of time to keep said electromagnetically operated element for said valve means energized to thereby allow said flame to stabilize.

11. A flame signal stabilization circuit as described in claim 10 wherein said pulse generating circuit means includes a diode connected in series with a first capacitor of said capacitor means; said diode and said first capacitor connected in parallel with an anode and a cathode of said silicon controlled rectifier; and said resistor means including a first resistor connected in parallel with said first capacitor to form a pulse generating output circuit which is connected to said flame sensing means.

12. A flame signal stabilization circuit as described in claim 11 wherein said flame rectification means includes a flame rod and a connection adapted to be electrically connected to said burner so that said flame at said burner acts as a rectifier.

13. A flame signal stabilization circuit as described in claim 5 wherein said pulse generating circuit means includes capacitor means and resistor means capable of storing a charge when no flame exists and subsequently producing a current pulse to said solid state switch means for said short period of time to keep said valve means energized to thereby allow said flame to stabilize.

14. A flame signal stabilization circuit as described in claim 13 wherein said pulse generating means includes a diode connected in series with a first capacitor of said capacitor means; said diode and said first capacitor connected in parallel with a portion of said solid state switch means; and said resistor means including a first resistor connected in parallel with said first capacitor to form a pulse generating output circuit which is connected to said flame sensing means.

15. A flame signal stabilization circuit as described in claim 14 wherein said flame rectification means includes a flame rod and a connection adapted to be electrically connected to said burner so that said flame at said burner acts as a rectifier.

* * * * *